United States Patent [19]

Kelly

[11] Patent Number: 4,940,405

[45] Date of Patent: Jul. 10, 1990

[54] PULSE COMBUSTION DRIVEN IN-FURNACE NOX AND SO2 CONTROL SYSTEM FOR FURNACES AND BOILERS

[76] Inventor: John T. Kelly, 109 Via De Tesoros, Los Gatos, Calif. 95030

[21] Appl. No.: 313,841

[22] Filed: Feb. 23, 1989

[51] Int. Cl.[5] ..... F23C 11/04

[52] U.S. Cl. ..... 431/1; 122/24; 431/4

[58] Field of Search ..... 431/1; 122/24

[56] References Cited

U.S. PATENT DOCUMENTS

| | | | |
|---|---|---|---|
| 2,748,753 | 6/1956 | Sarrazin et al. | 122/24 |
| 4,368,677 | 1/1983 | Kline | 431/1 |
| 4,671,056 | 6/1987 | Genz et al. | 431/1 |
| 4,779,545 | 10/1988 | Breen | 110/212 |

*Primary Examiner*—Carroll B. Dority

*Attorney, Agent, or Firm*—Flehr, Hohbach, Test, Albritton & Herbert

[57] ABSTRACT

Pulse combustors and associated air mixers are used to process fuel and calcium based sorbent outside of a furnace or boiler. liquid or solid fuel is rapidly volatilized in the air mixer of the first pulse combustor, producing high gaseous fuel content and a highly reactive char or soot. This material is then injected into the upper part of the furnace, above the conventional burners, to create a fuel rich zone which reduces previously formed nitrogen oxide (NOx) pollutants. The calcium based sorbent is injected into a second pulse combustor, located higher in the furnace. The sorbent is flash calcined in the air mixer of the pulse combustor yielding a high surface area sorbent. This material is then injected into the furnace above the first pulse combustor to reduce previously formed sulfur oxide (SO2) pollutants. In addition, the stream from this combustor and air mixer provides the air needed to completely burn out the coal fuel from the first pulse combustor. Besides a combined NOx and SO2 control, the system can be configured to only reduce either NOx or SO2.

8 Claims, 3 Drawing Sheets

PULSE COMBUSTION DRIVEN IN-FURNACE NOX AND SO2 CONTROL SYSTEM FOR FURNACES AND BOILERS

FIELD OF THE INVENTION

This invention pertains to the control of furnace and boiler NOx and SO2 emissions through in-furnace pollutant reduction techniques driven by pulse combustors mounted externally to the furnace. In particular, pulse combustors are used to generate flow and hot pulsating gases that process furnace injectants in air mixers outside of the furnace and then rapidly propell and disperse the injectants within the furnace to accomplish NOx and SO2 control. The injection occurs above the conventional burners.

BACKGROUND OF THE INVENTION

Large coal, refuse and oil fired boilers and furnaces produce significant quantities of SO2 and NOx emissions from the sulfur and nitrogen bound in the fuel. These pollutants can be controlled by existing flue gas techniques. However, these techniques are very costly and require space and utilities not always available at existing facilities.

Effective, low cost and retrofittable SO2 and NOx emission controls are needed for large boilers and furnaces to allow the widespread use of inexpensive fuels without adversely affecting the environment. Direct sorbent injection is a relatively economical and retrofittable SO2 capture technique. In this technique, a calcium based, or other type, sorbent is injected into the furnace, calcined, reacted with SO2 and captured in the particulate collection device. By maximizing the use of existing equipment, the cost for this technique is lower than flue gas scrubbing methods. However, SO2 capture for this technique is severely restricted by the non-optimal temperature profile within the furnace. This leads to limited sorbent active surface area development and sorbent sulfation. Also, conventional steady-state means of sorbent injection and mixing limits sorbent dispersion within the temperature range needed for effective sulfation. To make maximal use of the available time, sorbent must be calcined at the optimal temperature and then injected to rapidly penetrate the furnace gases and uniformly disperse the sorbent at the optimal temperature condition. This will allow sulfation to proceed a maximum amount prior to temperature quench in the convective section. Other problems in applying this technique include excessive sorbent deposition on heat transfer surfaces and the need for power consuming fans.

In-Furnace NOx Reduction (IFNR) is a relatively economical, effective, and retrofittable boiler NOx control technique. In this technique an excess of fuel is injected above the conventional burners, which then react with and reduce previously formed NOx to inactive nitrogen compounds. Air is then injected above the excess fuel zone to completely burn up any remaining fuel. Although a promising NOx control technique, IFNR is restricted in application by the limited time within the furnace for IFNR fuel dispersion, reaction with previously formed NOx and burnout. This is a particularly severe problem when coal is used as the IFNR fuel. For proper IFNR system operation, coal must quickly penetrate the furnace volume and disperse within the combustion product gases so that the NOx reduction reactions have sufficient time under fuel rich conditions. Also, once the NOx reduction process is completed, air must be added to burn out the fuel prior to temperature quenching in the convective section of the furnace. Because of injection high in the furnace, IFNR fuel burnout will occur at reduced temperatures and under very limited residence time. Consequently, this technique will not be applicable to many "tight" furnace or boiler designs, where residence time is insufficient for fuel burn out.

Thus, current direct sorbent injection SO2 control and in-furnace NOx reduction techniques are limited in performance due to non-optimal injectant processing conditions and limited penetration and dispersion of injectants in the furnace gases.

SUMMARY OF THE INVENTION

A Pulse Combustor In-Furnace SO2 and NOx Reduction (PCSN) system is to use the exhaust from pulsating combustors, in combination with air mixers, to optimally process IFNR fuel and sorbent outside of the furnace prior to injection and rapid dispersion of the IFNR fuel and sorbent into the furnace.

It is another object of the invention to optimize thermal histories and pulsating flow conditions within the air mixers to develop high active-surface area sorbents for SO2 control and to gasify coal and develop reactive chars for NOx control. The hot pulsating flow will enhance heat and mass transport within the air mixers relative to steady flow.

Another object of the invention is to optimize air mixer furnace nozzle and pulsation conditions to produce rapid penetration and dispersion of the injectants in the furnace gas. Mixing of injectants and furnace gases with pulsating flow will be significantly better than with conventional steady flow. The NOx within the furnace is reduced by the hydrocarbon fragments volatilized from the IFNR fuel and the active char or soot produced in the air mixers. The SO2 within the furnace is reduced by the high active area sorbent produced in the air mixer.

DESCRIPTION OF THE PREFERRED EMBODIMENTS

Figure 1:
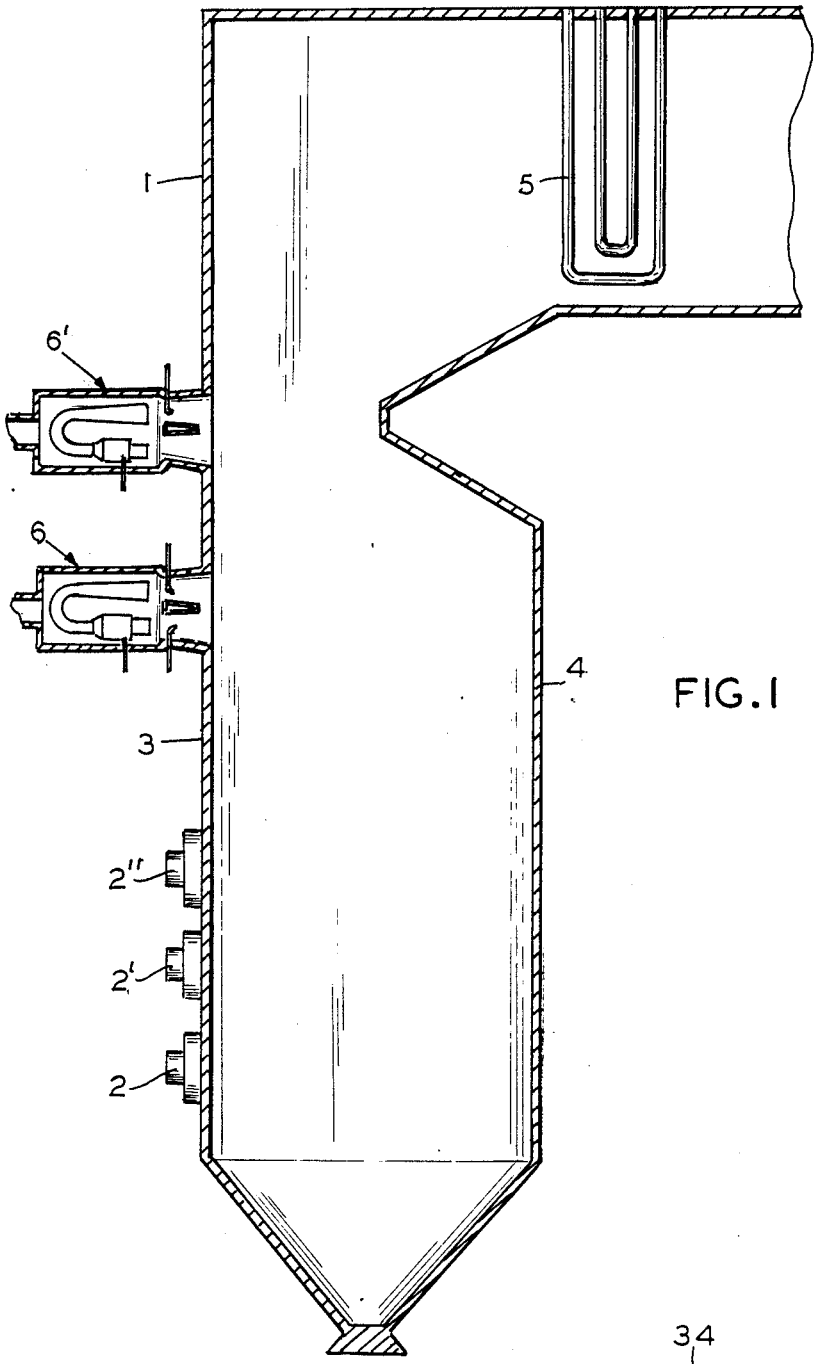
FIG. 1 is a vertical section view of a front wall fired boiler incorporating the invention.

A schematic of a generic utility boiler with the PCSN concept installed above the conventional burners is given in FIG. 1. The boiler consists of a chamber lined with water cooled walls, 1, in which the steam needed to drive the power turbines is ultimately formed. Solid or liquid fuel and needed combustion air are injected into the furnace chamber through several elevations of conventional burners, 2. For wall-fired boilers, the burners are located in either the front, 3, or front-and-back 3 and 4, walls. For tangentially fired boilers, the burners are located in the four corners of the typically rectangular cross section furnace. For a cyclone boiler, coal combustion takes place outside of the furnace in small cyclones attached to the front furnace wall and, primarily, only hot combusted gases enter the boiler. In a stoker boiler, coal is burned on a grate located at the bottom of the furnace. Some incinerators also operate in a manner similar to a stoker boiler. In all cases, combustion of the fuel in the lower sections of the furnace produces hot gases that transfer significant heat to the boiler walls. Due to the substantial sulfur and nitrogen content of many fuels, and the intense oxidation of the fuel within the furnace, a significant amount of nitrogen and sulfur oxides are formed within the furnace. Without the PCSN system, these pollutants typically exit the furnace and, if untreated by flue gas pollution control techniques, can leave the stack as air pollutants.

The furnace size is typically determined by the need to completely burn up the fuel prior to temperature quenching in the convective tube banks, 5. In addition, more recent furnace designs have increased furnace volume to reduce heat-flux-per cooled wall-surface-area. The reduction in wall heat flux helps lower NOx. However, due to cost considerations, most furnaces are small in the volume and produce substantial NOx and SO2 that eventually become acid rain and/or smog precursors.

A plurality of PCSN units 6 and 6' are installed along the upper furnace walls to ensure that the penetration and dispersion of injectants into the furnace gases are uniform. The number and location of units is dependent upon the design of the specific furnace. The lower PCSN unit 6 includes a pulse combustor, 7, which is used as a generator of two hot pulsating gas flows that are directed towards the furnace from inlet and outlet ports 8 and 9, respectively. The aerovalved combustor illustrated is simple and operates with no moving parts. A valved pulse combustor could also be used. Fuel is injected into the combustor through the fuel supply tube and nozzles, 10. The tailpipe of the pulse combustor is formed into a U shape to direct outflows of the combustor in the direction of the furnace. The pulse combustor operates over a cycle consisting of air ingestion and fuel mixing, precombustion compression, combustion, and expulsion of exhaust products. Once started by a spark plug, the combustor operates continuously without the need for external ignition devices or combustion air fans. A portion of the combustion energy is converted into flow momentum and acoustic energy. These are beneficially used to inject materials into the furnace and rapidly process the materials, respectively. Pulsating flow, of the type produced by the pulse combustor, has been previously shown to significantly augment gas/gas, gas/surface and gas/particle transport due to relative motion between the particles or still gas and the oscillating gas. This character is used to optimally process materials in the mixers 11 and 12.

Expelled hot gases from the pulse combustor enter the two zones which define air mixers, 11 and 12. The mixers are configured to operate as unsteady flow ejectors. The mixers entrain a substantial amount of air from the air casing, 13, which rapidly reduces the gas temperature to the optimal range. In the lower pulse combustor, pulverized coal, or other IFNR fuel, is injected through the pair of tubes **14*a* and 14*b*** into the air mixers. The fuel is rapidly devolatilized and ignited by the hot pulsating gases in the mixer. A total of approximately 10 to 30 percent of the fuel burned in the furnace is injected into the mixers. The amount of air entrained into the furnace through the mixers is insufficient to completely burn out the injected coal fuel. The hot pulsating gases and limited amount of air entrained into the mixers is sufficient to devolatize the coal, produce a reactive char, or soot, and create a relatively fuel rich zone in the furnace. The stoichiometric ratio for optimal furnace NOx reduction, with this mixture, is between 0.9 and 0.8.

The IFNR fuel volatilization products and char or soot are carried into the furnace by the pulsating jets where they are dispersed and mixed with the combustion products from the lower furnace. Prior work has shown that mixing and dispersion with pulsating jets is more effective than with steady jets that are typically used in conventional systems. The volatilization products and char, or soot, react under oxygen deficient conditions with the NOx formed in the lower furnace. The NOx is then substantially reduced to molecular nitrogen which then remains relatively unavailable for conversion to oxides in the upper furnace. Further, the reactive char or soot is partially gasified in the NOx reduction zone.

The upper level unit 6' comprises a pulse combustor 15, which produces a flow similar to the lower level combustor 7. The upper combustor entrains air through casing 13 and injects it into the furnace as needed to complete combustion. In addition, a calcium based sorbent is injected through a tube 16 into the zone which defines the air mixer, 17. The sorbent can either be in a dry powder form or a slurry. Limestones and calcitic hydrates are suitable sorbents for injection. Depending on the application, other sorbents could be utilized. The sorbent is rapidly calcined to a high active surface area in the mixers. This active sorbent is then injected and rapidly dispersed in the furnace by the pulsating flow. The sorbent then reacts with the SO2 generated previously, and converts the gaseous pollutant into a solid. The sulfated sorbent particles are then removed in the existing or upgraded particulate control device.

The location, number and orientation of the PCSN units 6 and 6' depend on the particular end use application. The NOx reduction units preferably are placed close to the upper burner level to allow a sufficient time for the reduction reactions to proceed prior to combustion completion air injection. The combustion completion air and sorbent injection must take place at a location where the furnace gas temperature is below 2200 F. and the sulfation reactions are thermodynamically and kinetically favored. As furnace load varies, the optimal injection locations will vary. Through injector tilt capability, where the angle of injection in the vertical plane can be varied, the system will be able to compensate for the movement of the optimal injection location. The presence of the pulsating flow into the furnace will help keep large deposits from forming on the tube walls. The pulsations will help "scrub" and dislodge deposits from the tubes particularly near the injector locations.

Figure 2:
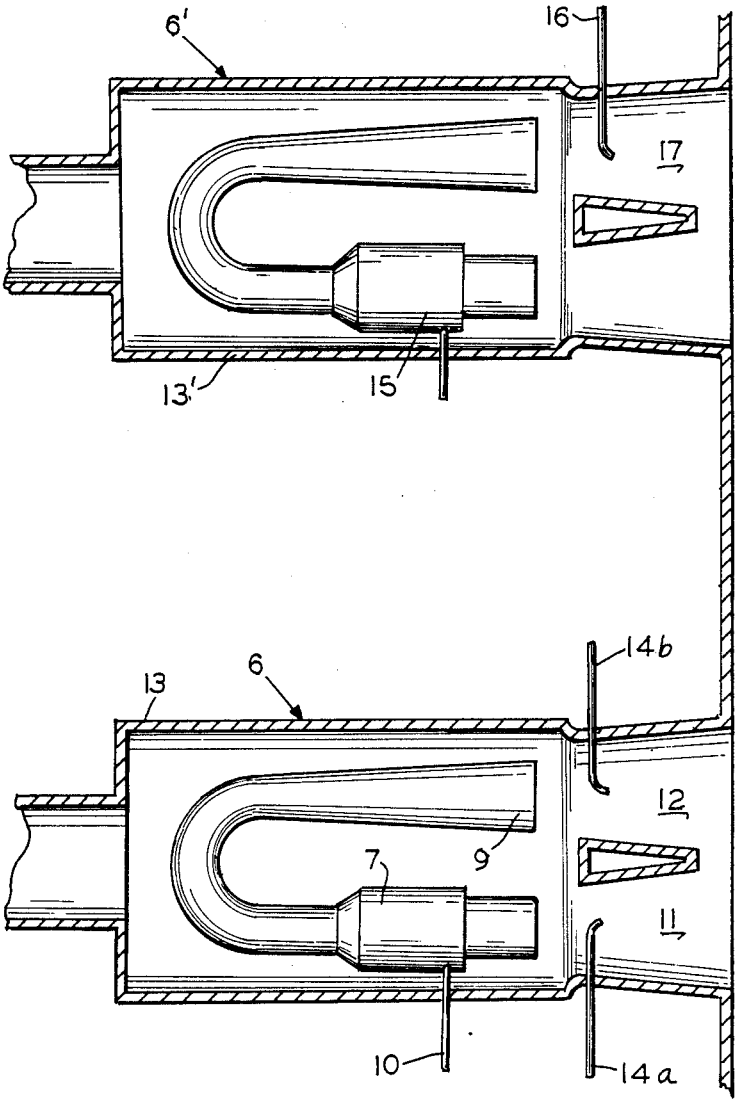
FIG. 2 is a vertical section view to an enlarged scale of the pulse combustors which are components of the boiler of FIG. 1.

As described above, the Pulse Combustor In-Furnace SO2 and NOx reduction system can improve SO2 and NOx control effectiveness at reduced cost relative to existing means by:

providing rapid heat transfer and mass transport to IFNR fuel to speed fuel gasification and burnout partially reacting fuel prior to entry into the furnace improving burnout of both IFNR and lower furnace fuel controlling temperature and concentrations for effective NOx reduction in the furnace rapidly releasing and transporting fuel fragments to NOx for rapid reduction preventing slippage of NOx around the fuel jets effectively penetrating the furnace volume
requiring less excess air for burnout than a conventional system
providing rapid heat transfer for flash calcination and development of high surface area sorbents
helping disperse and fragment sorbent particles and create high surface area sorbents
controlling temperature, concentrations and residence time for effective calcination external to the furnace
easily penetrating the furnace volume and rapidly disperses sorbent throughout the furnace
keeping tube banks clean
having few moving parts, and being simple, reliable and low cost
having low energy consumption due to direct conversion of combustion energy into flow momentum The preceding discussion has been presented in reference to the accompanying drawings and the contemplated best mode of practicing the invention. However, modifications can be made by those skilled in the art without departing from essential aspects of this invention. For example, the components presented in FIG. 2 could be configured to only control NOx or SO2 individually.

Figure 3:
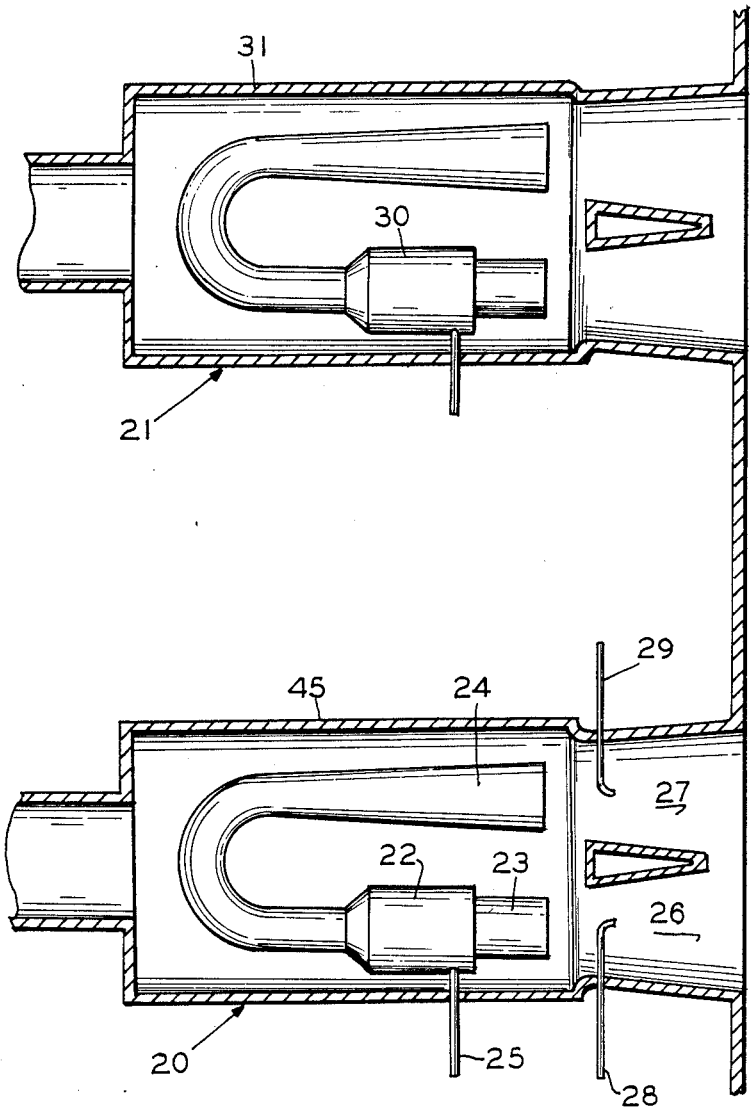
FIG. 3 is a vertical section view of pulse combustors which are components of the fired boiler of another embodiment of the invention.

FIG. 3 illustrates an embodiment providing two levels of PCSN units 20 and 21 which are components of a front wall fired boiler of a construction similar to the embodiment of FIG. 1. The lower unit 20 comprises a U-shaped pulse combustor 22 having an inlet port 23 and outlet port 24 together with a fuel supply nozzle 25. The conductor is mounted within an air casing 45 and air mixing zones 26 and 27 lead through an opening into the boiler wall. A pair of injector tubes 28 and 29 are provided to inject only pulverized coal or other IFNR fuel into lower unit 6.

In the embodiment of FIG. 3 the upper PCSN unit 21 injects only air into the boiler, and is comprised of a U-shaped pulse combustor 30 mounted within an air casing 31 to operate in a manner similar to combustor 22.

Figure 4:
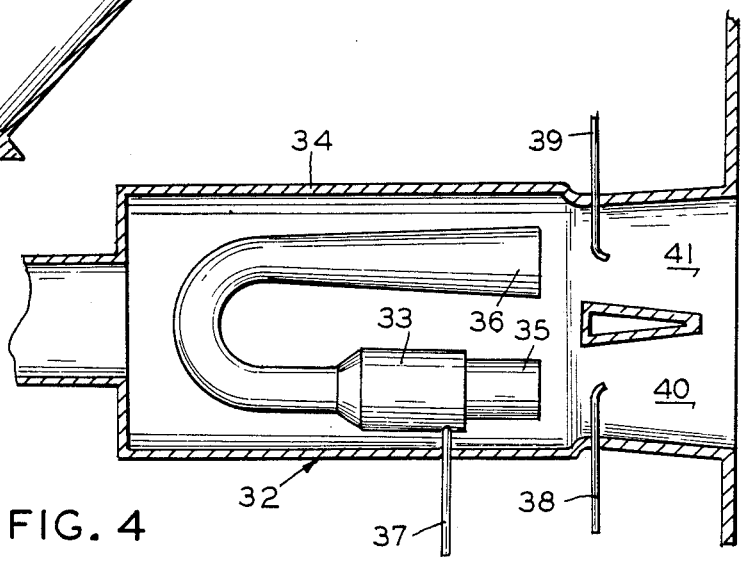
FIG. 4 is a vertical section view of a single pulse combustor which is a component of a fired boiler of another embodiment.

FIG. 4 illustrates another embodiment of the invention for SO2 control in which only one level of the PCSN units 32 are provided to inject sorbent into the boiler. The unit 32 is comprised of a U-shaped pulse combustor 33 mounted within an air casing 34. The combustor has an inlet port 35 and outlet port 36, with fuel supplied through nozzle 37. The sorbent is injected through the tubes 38 and 39 into the air mixer zones 40 and 41.

What is claimed is:

1. Apparatus for reducing the emission of NOx in a boiler or furnace system having a primary combustion chamber from which combustion products are directed upwardly along a path leading to an exhaust stack, the apparatus comprising the combination of first pulse combustor means for combusting a fuel with air in successive explosive pulses of hot combustion gases, means for entraining additional air with the pulses, means for injecting and mixing pulverized coal with the pulses and additional air, means for directing the mixture of coal, pulses and additional air into a first zone along said path for mixture with the combustion products, with fuel NOx in the combustion products being substantially reduced to molecular nitrogen by chemical reaction in the zone.

2. Apparatus as in claim 1 which includes second pulse combustor means for combusting a fuel with air in successive explosive pulses of hot combustion gases, means for entraining additional air with the pulses from the second combustor means, and means for injecting the pulses from the second combustor means with said entrained additional air into a second zone along said path which is above the first zone for substantial combustion of the remaining unburned reactants therein.

3. Apparatus as in claim 1 where said boiler or furnace system also produces SO2 the improvement including second pulse combustor means for combusting a fuel with air in successive explosive pulses of hot combustion gases, means for entraining additional air with the pulses from the second combustor means, means for injecting and mixing a sorbent into the pulses and additional air from the second combustor means, and means for directing said mixture of sorbent, pulses and additional air into a second zone along said path for mixture with the combustion products with the sorbent reacting with and converting gaseous SO2 in the combustion products into sulfated sorbent particulate matter and with unburned fuel reactants in the second zone being substantially combusted.

4. Apparatus as in claim 3 in which said sorbent is selected from the group consisting of particulate limestones and particulate calcitic hydrates.

5. In a boiler or furnace system which burns fuel and air in a combustion chamber to produce combustion products which include NOx and SO2 pollutants, a first pulse combustor which combusts a fuel with air to generate a series of explosive pulses of hot combustion gases which are directed along a first stream, means for directing additional air into the first stream, air mixer means for mixing the additional air with the combustion gases in the first stream, means for directing NOx reducing fuel into the mixture of hot combustion gases and additional air in the first stream, means for directing the mixture of NOx reducing fuel, additional air and pulses of combustion gases in the first stream into a zone for mixture with the combustion products from the chamber with NOx in the zone being substantially reduced to molecular nitrogen by chemical reaction, a second pulse combustor for producing a second stream of explosive pulses of hot combustion gases, second air mixer means for mixing additional air with the combustion gases of the second stream, means for injecting a sorbent into the mixture of additional air and pulses of combustion gases of the second stream, and means for directing the mixture of sorbent, additional air and pulses in the second stream into a second zone in the combustion products with SO2 therein reacting with the sorbent to produce sulfated sorbent particles.

6. A system as in claim 5 in which said sorbent is selected from the group consisting of particulate limestones and particulate calcitic hydrates.

7. A system as in claim 5 in which said NOx reducing fuel comprises pulverized coal.

8. Apparatus for reducing the emission of SO2 in a boiler or furnace system having a primary combustion chamber from which combustion products are directed upwardly along the path leading to an exhaust stack, the apparatus comprising a combination of pulse combustor means for combusting a fuel with air in successive explosive pulses of hot combustion gases, means for entraining additional air with the pulses from the combustor means, means for injecting and mixing a sorbent into the pulses and additional air from the combustor means, and means for directing said mixture of sorbent, pulses and additional air into a zone along said path for mixture with the combustion products with the sorbent reacting with and converting gaseous SO2 in the combustion products into sulfated sorbent particulate matter and with unburned fuel reactants in the zone being substantially combusted.

* * * * *